US007455040B2

(12) United States Patent
Hendriksma et al.

(10) Patent No.: US 7,455,040 B2
(45) Date of Patent: Nov. 25, 2008

(54) HYDRAULIC CIRCUIT FOR SWITCHABLE CAM FOLLOWERS

(75) Inventors: Nick J. Hendriksma, Grand Rapids, MI (US); Mark J. Spath, Spencerport, NY (US); Michael J. Dinkel, Penfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/545,198

(22) Filed: Oct. 10, 2006

(65) Prior Publication Data

US 2008/0083389 A1 Apr. 10, 2008

(51) Int. Cl.
*F01M 1/06* (2006.01)

(52) U.S. Cl. ..... 123/90.34; 123/90.12; 123/90.13; 123/90.55

(58) Field of Classification Search ..... 123/90.16, 123/90.39, 90.44, 90.45, 90.52, 90.33, 90.34, 123/90.12, 90.13, 90.2, 90.48, 90.55
See application file for complete search history.

(56) References Cited

U.S. PATENT DOCUMENTS

| | | | | |
|---|---|---|---|---|
| 2,956,642 | A | 10/1960 | Chaplin et al. | |
| 4,662,323 | A | 5/1987 | Moriya | |
| 5,090,364 | A | 2/1992 | McCarroll | |
| 5,101,778 | A | 4/1992 | Fukuo et al. | |
| 5,273,007 | A | 12/1993 | Ampferer | |
| 5,503,121 | A * | 4/1996 | Speil et al. | 123/90.22 |
| 5,803,051 | A | 9/1998 | Stehr | |
| 6,557,518 | B1 | 5/2003 | Albertson et al. | |
| 6,810,845 | B1 * | 11/2004 | Plenzler et al. | 123/90.33 |
| 6,810,846 | B2 | 11/2004 | Muraca et al. | |
| 6,883,484 | B2 | 4/2005 | Oka et al. | |
| 7,004,130 | B2 | 2/2006 | Bolz et al. | |
| 7,082,918 | B2 * | 8/2006 | Rozario et al. | 123/196 R |

FOREIGN PATENT DOCUMENTS

| | | |
|---|---|---|
| DE | 19735437 | 2/1998 |
| DE | 10300514 | 7/2003 |
| DE | 10 2004 028033 | 1/2005 |
| DE | 10346446 | 5/2005 |
| EP | 0 259 106 | 3/1988 |
| EP | 0364069 | 4/1990 |
| EP | 0 671 550 | 9/1995 |
| JP | 59 060016 | 4/1984 |
| JP | 63 176612 | 7/1988 |
| WO | 01/49978 | 7/2001 |

OTHER PUBLICATIONS

European Search Report dated Jun. 9, 2008.

* cited by examiner

*Primary Examiner*—Ching Chang
(74) *Attorney, Agent, or Firm*—Michael D. Smith

(57) ABSTRACT

An oil distribution system for an internal combustion engine comprising a longitudinal bore in the engine head or block connected to an engine oil pump. A longitudinal insert is disposed in the engine bore, the insert being formed and disposed to define segmented galleries within the bore, a first oil gallery being in communication with the engine camshaft bearings and a second oil gallery being in communication with switchable cam followers in the engine. The two galleries are separated but connected by one or more oil control valves. Thus, the camshaft bearings are exposed to high engine oil pressure at all times independent of the switchable cam followers; likewise, the switchable cam followers may be latched and unlatched at any time or condition deemed beneficial for engine operation without jeopardizing lubrication sufficiency to the camshaft bearings.

25 Claims, 4 Drawing Sheets

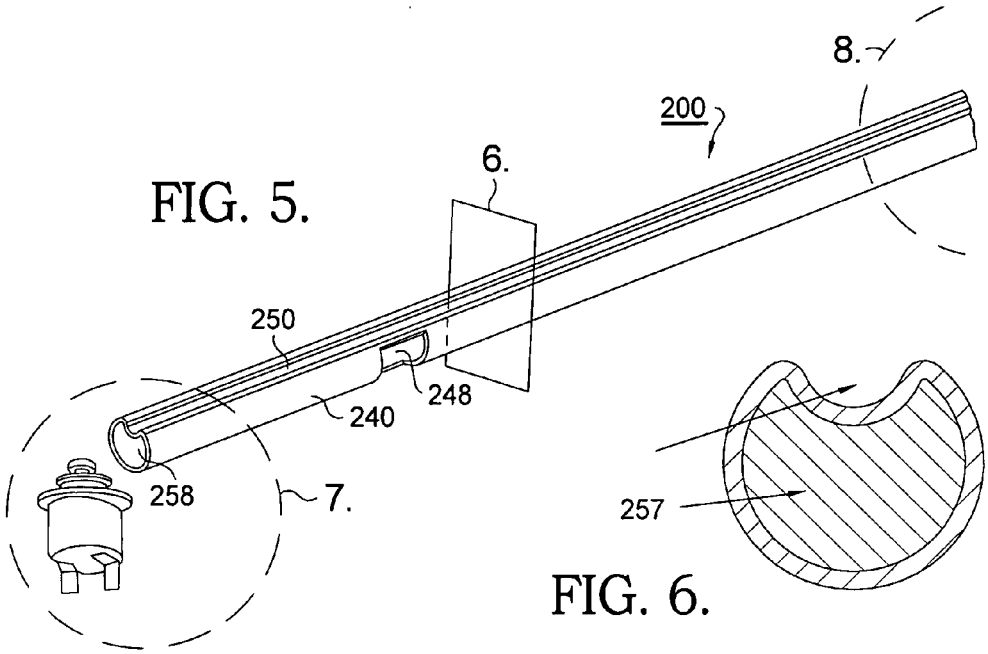
FIG. 5.
FIG. 6.
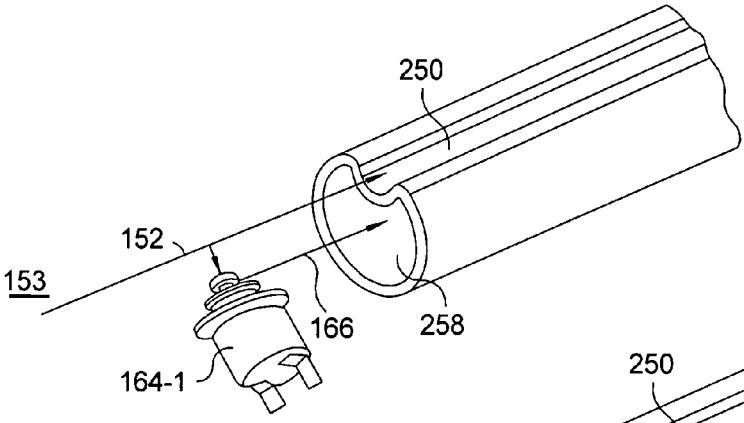
FIG. 7.
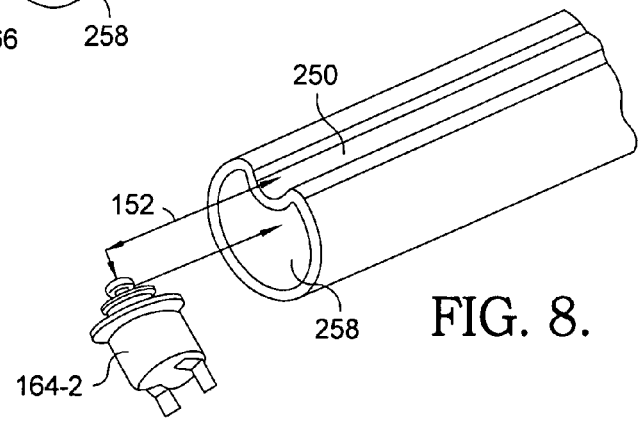
FIG. 8.

HYDRAULIC CIRCUIT FOR SWITCHABLE CAM FOLLOWERS

TECHNICAL FIELD

The present invention relates to a system for varying the lift and/or timing of combustion valves in internal combustion engines; more particularly, to such a system's hydraulic circuit for providing pressurized engine oil to switchable cam followers; and most particularly, to segmented oil galleries formed in a single oil bore in an engine to supply independently the camshaft bearings and the switchable cam followers over a broad range of engine operating conditions.

BACKGROUND OF THE INVENTION

In the block or head of an internal combustion engine, lubrication is provided typically via a single primary longitudinal bore supplying oil to a plurality of intersecting secondary bores leading to individual camshaft bearings and hydraulic lash adjusters (HLAs) or hydraulic lifters (HLs).

Typical switchable cam followers for varying the lift and/or timing of combustion valves of an engine, whether in an engine head or engine block, utilize hydraulically actuated lock pins to implement a mode change in the system. For example, a switchable valve lifter used in a cam-in-block engine functions as a conventional hydraulic valve lifter when low oil pressure is supplied to a switching gallery; when high oil pressure is enabled, a lock pin is displaced and the lifter switches to a deactivated mode of operation wherein camshaft motion is lost in the lifter and not transmitted to the associated combustion valve stem.

In a similar way, a switchable rocker arm assembly, as used in a cam-in-head changes between a high lift and a low lift mode of operation (known in the art as a two-step roller finger follower (RFF)) or between a high lift and a no lift mode of operation (known in the art as a deactivating RFF) depending upon the oil pressure in the switching gallery. A typical prior art switchable rocker arm assembly includes an articulated switchable RFF disposed between an engine camshaft lobe and a valve stem. The switchable RFF includes a hydraulically-actuated lock pin to engage or disengage the articulated members. Typically, the lock pin is engaged between the articulated members by a return spring. The lock pin is disengaged by application of high pressure hydraulic fluid, typically engine oil provided by the engine's oil distribution system, to overcome the return spring. The switchable RFF is pivoted on an HLA at an end opposite to the valve-engaging end. The HLA is mounted in a residence bore in the engine head. The HLA is supplied with engine oil from a molded or bored single channel oil gallery in the engine head to feed the lash adjuster mechanism therein, and oil also flows from the HLA to the switchable RFF through a central opening in the ball head of the HLA and a mating passage in the switchable RFF. When oil is supplied through the single channel oil gallery at low pressure, the lock pin spring overcomes the oil pressure and the switchable RFF is in the latched mode. To overcome the lock pin spring, the oil pressure is increased through the HLA via an oil control valve (OCV) to a higher pressure sufficient to cause the lock pin to be retracted, placing the switchable RFF in its unlatched mode. The single channel oil gallery thus doubles as a switching gallery to the switchable RFF and an oil supply gallery for lubricating the camshaft bearings.

A problem arises in using a single channel oil gallery in such a dual mode, for either a cam-in-block switchable lifter or a cam-in-head switchable RFF, in that the pressure logic of a switchable application mandates that oil pressure in the gallery be reduced when latching of the device is desired while, at the same time, having to sufficiently lubricate the camshaft bearings. Under these conditions, the reduced oil pressure can result in premature bearing wear or outright failure.

One known approach to preventing this problem is to provide a secondary switching gallery adjacent the primary gallery specifically for supplying the switchable RFF (or switchable lifter) so as to dedicate the primary oil gallery for only the lash adjustment and camshaft bearing lubrication requirements. Disadvantageously, this approach requires significant changes in the prior art oil circuitry to provide independent oil feeds for the switching functions. See, for example, U.S. Pat. No. 6,557,518, wherein the switching function for a switchable RFF is resident in the HLA itself. Such a design most conveniently requires an entirely new two-piece plunger arrangement and reduces significantly the volume of the HLA low-pressure chamber, raising concerns for potential noise upon cold start of the engine. Further, it can be difficult and expensive to provide two adjacent galleries so close together within an engine block or head; and further, significant leakage can occur between the two galleries along the wall of the HLA residence bore.

What is needed in the art is an oil gallery circuit wherein the camshaft bearings are lubricated via a first oil gallery which does not communicate with the switchable cam follower and the latching/unlatching functions of the switchable cam follower are satisfied from a second, independently controlled oil gallery, and wherein both galleries are provided within a single, preferably prior art, longitudinal bore in the engine block or head.

What is further needed in the art is a means for segregating the second oil gallery from the primary oil gallery to permit use of a plurality of OCVs for synchronized mode changes of the switchable cam followers, without requiring extensive modification of a conventional engine block or cylinder head.

What is further needed in the art is a means for segmenting the second oil gallery for selectively and separately controlling switchable cam followers within a single bank of cylinders.

It is a principal object of the present invention to meet simultaneously the camshaft oil supply requirements and the oil supply requirements of the switchable cam followers of an internal combustion engine without requiring significant changes in prior art engine block or head configurations.

SUMMARY OF THE INVENTION

Briefly described, an oil distribution system for an internal combustion engine comprises a longitudinal bore in the engine head or block connected to an engine oil pump. A longitudinal insert is disposed in the engine bore, the insert being formed and disposed to define two parallel galleries within the bore, a first oil gallery in communication with the engine camshaft bearings and a second oil gallery in communication with switchable cam followers in the engine. The two galleries are separated by one or more oil control valves. Thus, the camshaft bearings are exposed to a suitable oil pressure for lubrication at all times independent of the switchable cam followers; likewise, the switchable cam followers may be latched and unlatched at any time or condition deemed beneficial for engine operation without jeopardizing lubrication sufficiency to the camshaft bearings.

BRIEF DESCRIPTION OF THE DRAWINGS

The present invention will now be described, by way of example, with reference to the accompanying drawings, in which:

FIG. 5 is an isometric view showing a second embodiment of a bore insert in accordance with the invention;

FIG. 6 is a cross-sectional view taken at plane 6 in FIG. 5;

FIG. 7 is detailed view taken at circle 7 in FIG. 5; and

FIG. 8 is a detailed view taken at circle 8 in FIG. 5.

Corresponding reference characters indicate corresponding parts throughout the several views. The exemplifications set out herein illustrate two preferred embodiments of the invention, and such exemplifications are not to be construed as limiting the scope of the invention in any manner.

DESCRIPTION OF THE PREFERRED EMBODIMENTS

Figure 1:
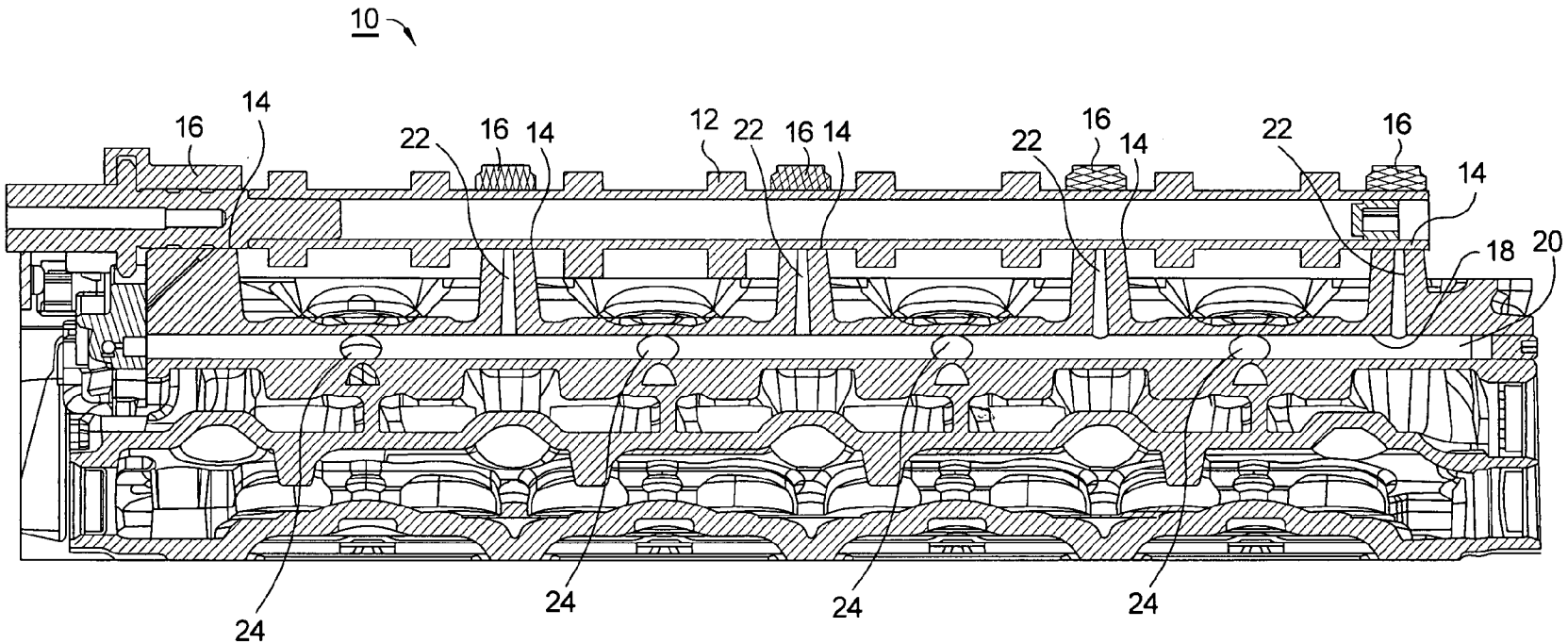
FIG. 1. (PRIOR ART)
FIG. 1 is an elevational cross-sectional view of a prior art head for an internal combustion engine, showing a single longitudinal oil bore supplying oil to cam bearing risers and switchable cam followers.

Referring to FIG. 1, a prior art internal combustion cam-in-head engine head 10, having switchable RFFs, includes a camshaft 12 mounted on camshaft bearings 14 and bearing caps 16. A longitudinal bore 18 defines a primary oil gallery 20 for feeding lubricating oil from a pressurized oil source (not shown, but typically a sump pump in an engine crankcase) to a plurality of oil risers 22 for lubricating camshaft bearings 14. Bore 18 also intersects secondary bores 24 for receiving and filling a plurality of hydraulic lash adjusters (not visible) and for serving switched oil pressures to the switchable RFFs.

Although not specifically shown herein, it will be appreciated that, within the scope of the prior art, bore 18 and risers 22 alternatively may be formed in an engine block of a cam-in-block (L-head or pushrod-type) engine, and secondary bores 24 provided for latching/unlatching switchable valve lifters. Likewise, the invention described herein, although shown for only a cam-in-head engine, is also applicable to such a cam-in-block engine.

As noted above, a problem in prior art internal combustion engines occurs when the operating oil for switchable cam followers, such as switchable RFFs, are supplied by the same oil gallery as the gallery supplying oil to lubricate the camshaft bearings. Under certain conditions, while the camshaft bearing lubricating requirements are high, the oil pressure in the common gallery must be reduced to control the switchable cam followers.

Figure 2:
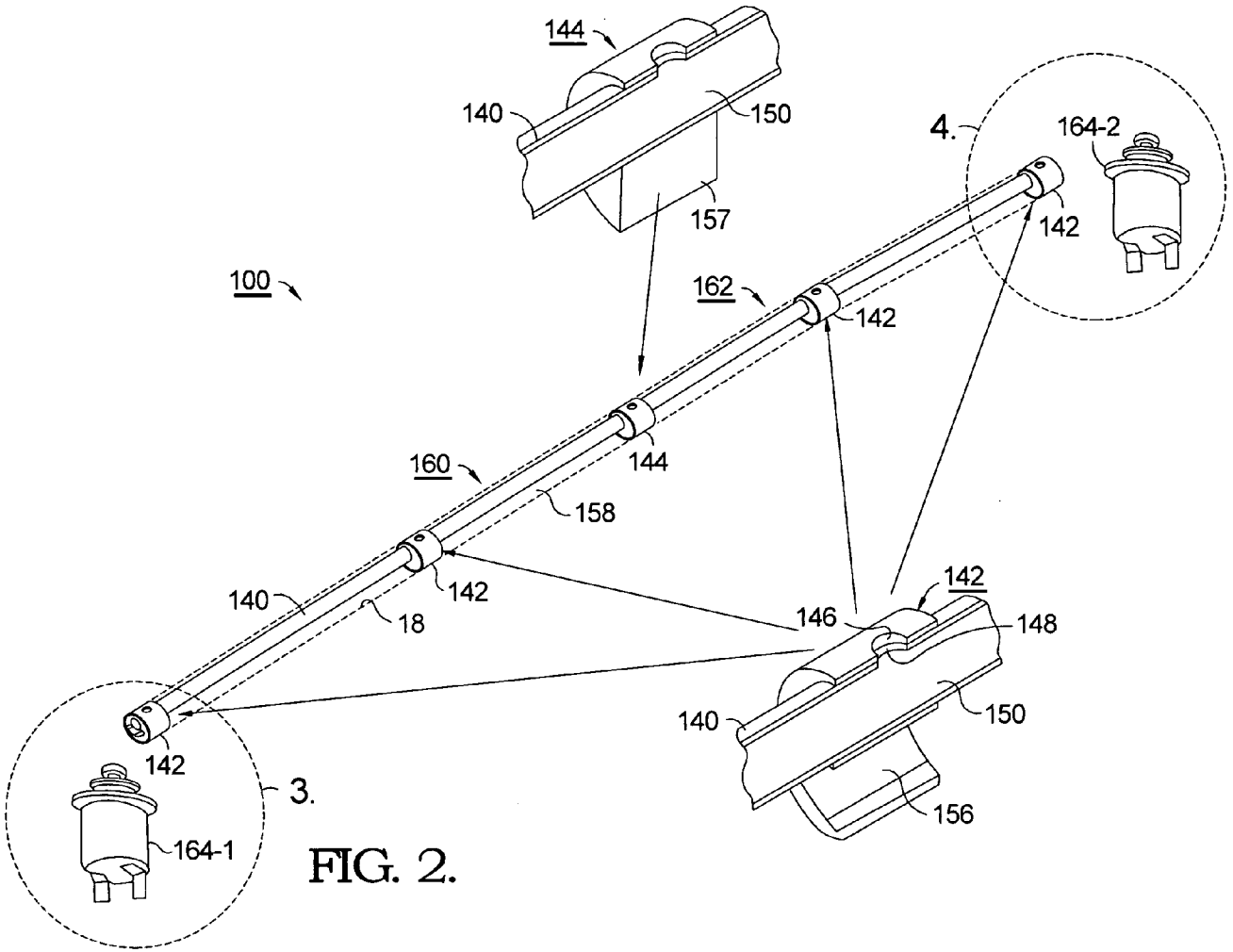
FIG. 2 is an isometric view showing a first embodiment of a bore insert in accordance with the invention.
Figure 3:
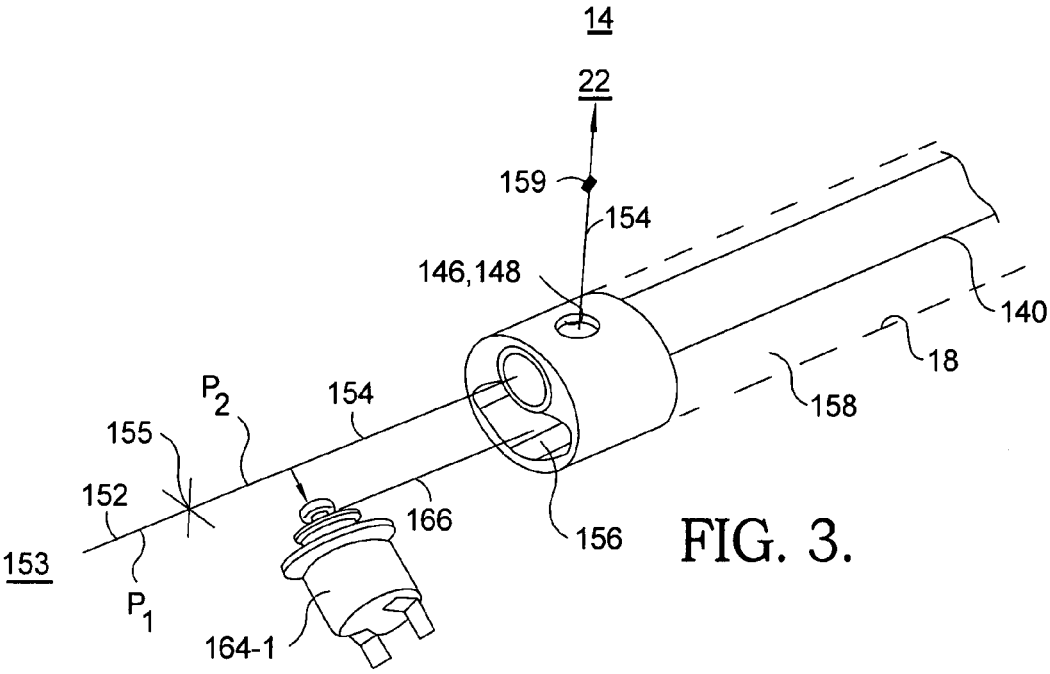
FIG. 3 is a detailed view taken at circle 3 in FIG. 2.
Figure 4:
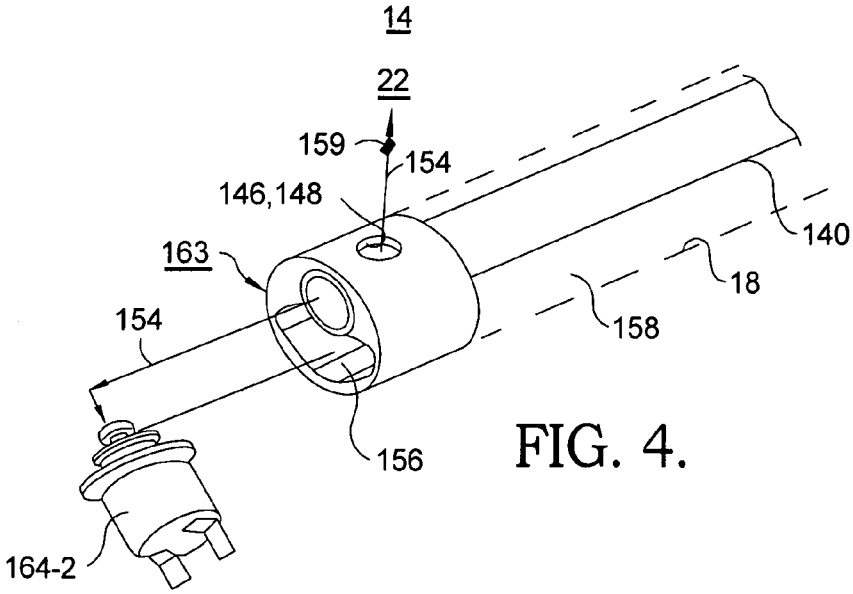
FIG. 4 is a detailed view taken at circle 4 in FIG. 2.

Referring now to FIGS. 2 through 4, in a first embodiment 100 of an insert assembly in accordance with the invention, a tube 140 having a diameter less than the diameter of engine bore 18 is provided with a plurality of bushings 142,144 located to correspond axially with cam bearing risers 22 when embodiment 100 is installed into engine bore 18. All bushings 142,144 include openings 146 coinciding with openings 148 in tube 140. The interior of tube 140 thus defines a first oil gallery 150 wherein pressurized oil 152 from a source 153, may be provided 154 via openings 146,148 to each riser 22 to lubricate cam bearings 14. Typically, restriction 155 is placed in the oil feed line downstream of oil source 153 to optimally reduce the pressure of the oil needed for lubricating the cam bearings from a first pressure $P_1$ to a second pressure $P_2$.

Bushings 142 at the ends and immediately inboard therefrom are further provided with an axial opening 156, allowing oil to flow within bore 18 but on the outside of tube 140, defining thereby a second oil gallery 158 independent of first oil gallery 150, both galleries 150,158 being contained within prior art engine bore 18, second oil gallery 158 intersecting with secondary bores 24 for feeding switching oil to the switchable cam followers. Preferably, tube 140 is disposed eccentrically relative to the axis of bore 18 to provide ample room for secondary bores 24 to intersect second oil gallery 158 without being restricted by tube 140.

Preferably, central bushing 144 is not provided with an axial opening 156 and thereby defines a wall 157 dividing second oil gallery 158 into two segments 160,162 which advantageously may be supplied and controlled independently as desired, as follows. Oil supply 154, at reduced pressure $P_2$, passes through the first controllable oil control valve 164-1 (FIG. 3), preferably a solenoid-actuated 3-way valve, which controllably diverts a portion 166 of flow 154 through secondary gallery 158 upon command from an engine controller (not shown). Because secondary bores 24 (FIG. 1) are disposed axially between risers 22 and therefore are not blocked by bushings 142, the first two bores 24 are supplied with oil portion 166, at reduced pressure $P_2$ from gallery segment 160, whenever first oil control valve 164-1 is opened. Preferably, a second oil control valve 164-2 is disposed at the distal end 163 of primary gallery 150 and thus receives the residual of flow 154 at pressure $P_2$. When opened upon command from the engine controller, secondary oil control valve 164-2 provides pressurized oil at pressure $P_2$ to the second two bores 24 that open into gallery segment 162. Thus, the latching/unlatching of the valves in the first two engine cylinders, dependent upon gallery segment 160, may be differentiated in time from the latching/unlatching of the valves in the second two engine cylinders, which are dependent upon gallery segment 162. Of course, if only a single OCV 164 is needed, it may be mounted anywhere along tube 140, as long as all bushings 142,144 include axial openings 156 and the valve extends into first gallery 150 for oil supply to second gallery 158.

In order to assure reliable and repeatable switching of the switchable cam followers under all engine operating conditions, it is best that the pressure of the oil received by valves 164-1, 164-2 from flow 154 be as high as possible. In one aspect of the invention, restriction 155 is moved from a position in the feed line just downstream of the oil source 153 as in the prior art to a further point downstream such as to a point 159 (FIGS. 3 and 4) in each riser 22 leading to camshaft bearings 14. As such, the camshaft bearings receive lubricating oil at an optimum pressure $P_2$, while valves 164-1, 164-2 receive switching oil at a desirable higher pressure, $P_1$.

Bushings 142, 144 may be readily attached to tube 140 by a method similar to a method for attaching camshaft lobes to a shaft. The bushings are positioned along the tube in their desired axial locations, and then an oversize ball or slug is forced through the inside diameter of the tube to create a press fit between each bushing and the tube. Other examples of methods contemplated by the invention for attaching bushings 142, 144 to tube 140 include casting, brazing, welding, press fitting and the use of adhesives.

Referring now to FIGS. 5 through 8, a second embodiment 200 is shown. A tube 240 is formed from metal or plastic, as by rolling or extruding from sheet stock or by extrusion, which tube is substantially full-fitting in bore 18. Tube 240 is creased inwards as by stamping or drawing to create a longitudinal crease defining a first oil gallery 250 between the crease and the inner wall of bore 18, and simultaneously creating a second oil gallery 258 within tube 240. In embodiment 200, first gallery 250 is inherently open to all the camshaft bearing risers 22, whereas second gallery 258 in tube 240 is provided with openings 248 at appropriate axial locations to mate with secondary bores 24 when tube 240 is installed into bore 18. If desired, as in first embodiment 100, a wall 257 may be inserted into tube 240 to partition second gallery 258 into a first portion 260 and a second portion 262 for independent deactivation control by first and second oil control valves 164-1, 164-2. Oil flow and oil control valve action is identical with that already described for embodiment 100.

In both embodiments 100, 200, the first oil control valves 164-1 are shown schematically as being adjacent to the entrance end of tube 140, 240. In practice, it may be preferable to locate the control valve or valves near a cam bearing tower such that the oil in a riser 22 also serves as the oil supply to the oil control valve. The output from the OCV is then routed to the second gallery. This arrangement eliminates having to provide additional passages in the engine head for oil supply to the OCVs.

OCVs in accordance with the invention can be substantially simpler and less expensive than the pressure-regulating spool-type OCV required in prior art systems. Generally speaking, a simple three-way on/off valve can be used. Further, persons of ordinary skill in the art may envision still-simpler and less-expensive systems employing fixed flow restrictions coupled with ball-type pressure relief valves to regulate the oil pressure in the second oil gallery to desired levels, for example, 0.5 bar.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An oil distribution system for an internal combustion engine having a pressurized oil source, at least one camshaft bearing, and at least one oil-actuated switchable cam follower, comprising:

a) a bore in said engine in fluid communication with said pressurized oil source; and b) a tubular insert disposed in said bore, said insert being formed and disposed to define a first oil gallery in communication with said at least one camshaft bearing and a second oil gallery in communication with said at least one switchable cam follower, wherein said bore has a central axis and said first oil gallery has a central axis and said gallery central axis is eccentric of said bore central axis.

2. An oil distribution system in accordance with claim 1 wherein said bore is formed in an engine component selected from the group consisting of an engine block and an engine head.

3. An oil distribution system in accordance with claim 1 further comprising at least one oil control valve disposed in communication with said second gallery for selectively varying oil pressure in said second oil gallery.

4. An oil distribution system in accordance with claim 1 wherein said insert is formed from a material selected from the group consisting of metal, plastic, and combinations thereof.

5. An oil distribution system in accordance with claim 1 wherein said insert is formed by rolling and stamping from planar stock.

6. An oil distribution system in accordance with claim 1 wherein said insert is formed by extrusion.

7. An oil distribution system in accordance with claim 1 wherein said insert is formed from tubular stock.

8. An oil distribution system in accordance with claim 1 comprising a plurality of camshaft bearings in communication with said first oil gallery.

9. An oil distribution system in accordance with claim 1 comprising a plurality of switchable cam followers in communication with said second oil gallery.

10. An oil distribution system in accordance with claim 1 wherein said at least one switchable cam follower is selected from the group consisting of a switchable roller finger follower and a switchable valve lifter.

11. An oil distribution system in accordance with claim 1 further comprising a riser in flow communication between said first oil gallery and said at least one camshaft bearing, said riser including a restriction for reducing an oil pressure to said at least one camshaft bearing.

12. An oil distribution system in accordance with claim 1 wherein said central axis of said first oil gallery is eccentric relative to said central axis of said bore along the entire length of said insert.

13. An oil distribution system in accordance with claim 1 wherein said second gallery comprises a first portion and a second portion.

14. An oil distribution system in accordance with claim 1 further comprising a support member positioned between said bore and said insert, wherein said support member defines a wall that divides said first portion and said second portion.

15. An oil distribution system for an internal combustion engine having a pressurized oil source, at least one camshaft bearing, and at least one oil-actuated switchable cam follower, comprising:

a) a bore in said engine in fluid communication with said pressurized oil source;

b) an insert disposed in said bore, said insert being formed and disposed to define a first oil gallery in communication with said at least one camshaft bearing and a second oil gallery in communication with said at least one switchable cam follower, wherein said second gallery comprises a first portion and a second portion; and c) a first and second oil control valves, wherein said first control valve is disposed in communication with said first portion of said second gallery for selectively varying oil pressure in said first portion and said second control valve is disposed in communication with said second portion of said second gallery for selectively varying oil pressure in said second portion.

16. An oil distribution system in accordance with claim 15 wherein said insert is tubular.

17. An oil distribution system in accordance with claim 15 wherein said bore has a central axis and said first oil gallery has a central axis and said gallery central axis is eccentric of said bore central axis.

18. An oil distribution system in accordance with claim 17 wherein said central axis of said first oil gallery is eccentric relative to said central axis of said bore along the entire length of said insert.

19. An oil distribution system in accordance with claim 15 further comprising a support member positioned between said bore and said insert, wherein said support member defines a wall that divides said first portion and said second portion.

20. An oil distribution system for an internal combustion engine having a pressurized oil source, at least one camshaft bearing, and at least one oil-actuated switchable cam follower, comprising;

a) a bore in said engine in fluid communication with said pressurized oil source; and b) an insert disposed in said bore, said insert being formed and disposed to define a first oil gallery in communication with said at least one camshaft bearing and a second oil gallery in communication with said at least one switchable cam follower;

c) at least one oil control valve disposed in communication with said second gallery for selectively varying oil pressure in said second oil gallery; and d) at least one hydraulic lash adjuster disposed in said second gallery between said at least one oil control valve and said at least one switchable cam follower.

21. An oil distribution system in accordance with claim 20 wherein said insert is tubular.

22. An oil distribution system in accordance with claim 20 wherein said bore has a central axis and said first oil gallery has a central axis and said gallery central axis is eccentric of said bore central axis.

23. An oil distribution system in accordance with claim 22 wherein said central axis of said first oil gallery is eccentric relative to said central axis of said bore along the entire length of said insert.

24. An oil distribution system in accordance with claim 20 further comprising a support member positioned between said bore and said insert, wherein said support member defines a wall that divides said first portion and said second portion.

25. An internal combustion engine comprising an oil distribution system having a pressurized oil source, at least one camshaft bearing, and at least one oil-actuated switchable cam follower, said oil distribution system including a bore in said engine in fluid communication with said pressurized oil source, and a tubular insert disposed in said bore, said insert being formed and disposed to define a first oil gallery in communication with said camshaft bearing and a second oil gallery in communication with said switchable cam follower, wherein said bore has a central axis and said first oil gallery has a central axis and said gallery central axis is eccentric of said bore central axis.

* * * * *